US009493934B2

(12) United States Patent
Clayton et al.

(10) Patent No.: US 9,493,934 B2
(45) Date of Patent: Nov. 15, 2016

(54) SINK COVER

(71) Applicants: Melissa Clayton, Acton, MA (US); Michael Clayton, Acton, MA (US)

(72) Inventors: Melissa Clayton, Acton, MA (US); Michael Clayton, Acton, MA (US)

(73) Assignee: THE MATTE LLC, Acton, MA (US)

( * ) Notice: Subject to any disclaimer, the term of this patent is extended or adjusted under 35 U.S.C. 154(b) by 97 days.

(21) Appl. No.: 14/083,630

(22) Filed: Nov. 19, 2013

(65) Prior Publication Data

US 2014/0137321 A1 May 22, 2014

Related U.S. Application Data

(60) Provisional application No. 61/727,861, filed on Nov. 19, 2012.

(51) Int. Cl.
*A47K 3/00* (2006.01)
*E03C 1/186* (2006.01)

(52) U.S. Cl.
CPC ..... *E03C 1/186* (2013.01)

(58) Field of Classification Search
CPC ..... E03C 1/186; E05D 1/00; E05D 1/02; Y10T 16/525; Y10T 16/5253; Y10T 16/5257; A45C 2011/001; A45C 2011/002; A45C 2011/003; A47D 5/006
USPC ..... 4/559, 605, 661, 654; 206/581, 45.24, 206/45.23, 45.21, 320
See application file for complete search history.

(56) References Cited

U.S. PATENT DOCUMENTS

| | | | | | |
|---|---|---|---|---|---|
| 2,147,805 | A * | 2/1939 | Windsor | A47K 1/06 | 4/655 |
| 3,988,784 | A * | 11/1976 | Reedy | E03C 1/186 | 4/654 |
| 4,351,073 | A * | 9/1982 | Elsas | 4/654 | |
| 5,299,683 | A * | 4/1994 | Poole | 206/77.1 | |
| 5,522,508 | A * | 6/1996 | Pesola | 206/579 | |
| D401,405 | S * | 11/1998 | Kim et al. | D3/205 | |
| 5,833,330 | A * | 11/1998 | Kos | 312/209 | |
| 5,984,092 | A * | 11/1999 | Heard-Willmon | 206/233 | |
| 6,109,442 | A * | 8/2000 | Roegner | 206/581 | |
| 6,223,754 | B1 * | 5/2001 | Burdi et al. | 132/300 | |
| 6,611,972 | B2 * | 9/2003 | Underbrink et al. | 4/619 | |
| 6,640,813 | B2 * | 11/2003 | Raisner et al. | 132/200 | |
| 7,086,099 | B2 * | 8/2006 | Rocci | 4/656 | |
| 7,363,936 | B1 * | 4/2008 | Simoneaux et al. | 137/312 | |
| 7,685,654 | B1 * | 3/2010 | Jones | A47K 1/06 | 4/245.6 |
| 7,866,368 | B2 * | 1/2011 | Ostrovsky | E05D 15/165 | 160/201 |
| 8,727,653 | B2 * | 5/2014 | Nelson | A45C 7/0054 | 206/214 |
| 9,032,567 | B1 * | 5/2015 | Galgano | E03C 1/186 | 4/657 |
| 2005/0172397 | A1 * | 8/2005 | Jones | 4/655 | |

* cited by examiner

*Primary Examiner* — Erin Deery
(74) *Attorney, Agent, or Firm* — Anderson Gorecki & Rouille LLP

(57) ABSTRACT

A foldable sink cover is presented. The sink cover comprises a foldable substrate having a base section and at least one foldable section in mechanical communication with the base section, wherein the foldable substrate is capable of being unfolded to cover a sink, and capable of being folded for storage when not being used to cover a sink.

12 Claims, 9 Drawing Sheets

SINK COVER

CROSS REFERENCE TO RELATED APPLICATIONS

The present application claims the benefit of U.S. Provisional Patent Application No. 61/727,861, filed on Nov. 19, 2012, which is incorporated herein by reference in its entirety.

BACKGROUND

In homes, apartments, hotel rooms and other living spaces, one issue that seems prevalent is the limited amount of counter space in a bathroom. Typically, a bathroom counter includes one (or more) bathroom sink(s) which take up valuable counter space and render it unusable for storing items. The need for additional counter space is highly desirable. The need for additional counter space is especially true when a person is getting ready to go to work or to go out, where they need to use hair care products, dental products, beauty aids, makeup and the like. This lack of counter space can result in the floor or toilet seat covers being used to temporarily store the hair care products, dental products, beauty aids, makeup and the like.

SUMMARY

Given the problem of limited counter space in the bathroom, it is desirable to overcome such deficiencies and provide a portable sink cover that can be used to cover the sink and act as a temporary counter top when required. In a particular embodiment the sink cover comprises a foldable substrate having a base section and at least one foldable section in mechanical communication with the base section, wherein said foldable substrate is capable of being unfolded to cover a sink, and capable of being folded for storage when not being used to cover a sink.

Note that each of the different features, techniques, configurations, etc. discussed in this disclosure can be executed independently or in combination. Accordingly, the present invention can be embodied and viewed in many different ways. Also, note that this summary section herein does not specify every embodiment and/or incrementally novel aspect of the present disclosure or claimed invention. Instead, this summary only provides a preliminary discussion of different embodiments and corresponding points of novelty over conventional techniques. For additional details, elements, and/or possible perspectives (permutations) of the invention, the reader is directed to the Detailed Description section and corresponding figures of the present disclosure as further discussed below. All examples and features mentioned below can be combined in any technically possible way.

BRIEF DESCRIPTION OF THE DRAWINGS

The foregoing will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
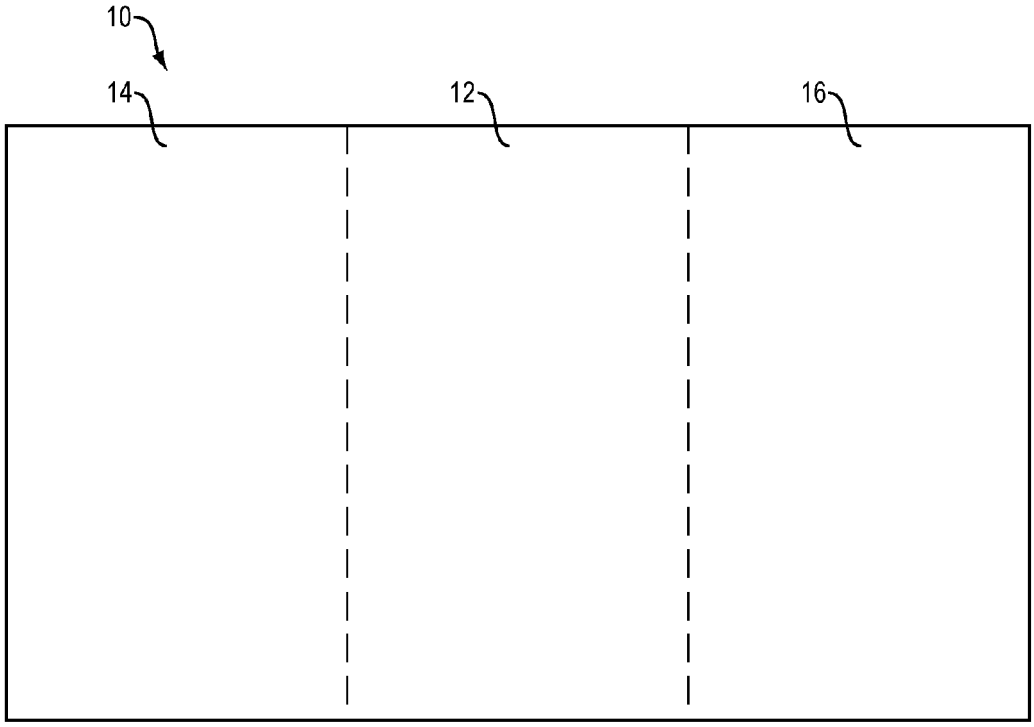
FIG. 1 illustrates a sink cover in accordance with a first embodiment of the invention.

The embodiments set forth below represent the necessary information to enable those skilled in the art to practice the invention and illustrate the best mode of practicing embodiments of the invention. Upon reading the following description in light of the accompanying figures, those skilled in the art will understand the concepts of the invention and recognize applications of these concepts not particularly addressed herein. It should be understood that these concepts and applications fall within the scope of the disclosure and the accompanying claims.

The preferred embodiment of the invention will now be described with reference to the accompanying drawings. The invention may, however, be embodied in many different forms and should not be construed as limited to the embodiment set forth herein; rather, this embodiment is provided so that this disclosure will be thorough and complete, and will fully convey the scope of the invention to those skilled in the art. The terminology used in the detailed description of the particular embodiment illustrated in the accompanying drawings is not intended to be limiting of the invention. In the drawings, like numbers refer to like elements.

Referring to FIG. 1, a particular embodiment of a sink cover 10 is shown. The sink cover 10 comprises a foldable substrate including a base section 12 and at least one foldable section (14, 16) in mechanical communication with the base section 12. In this example the sink cover 10 is shown having two foldable sections 14 and 16, though it should be understood that any number of foldable sections could be used. When the foldable sections 14 and 16 are unfolded the sink cover is usable to cover an open area of a sink. This provides additional counter space, especially useful for temporarily storing cosmetics and appliances.

Figure 2:
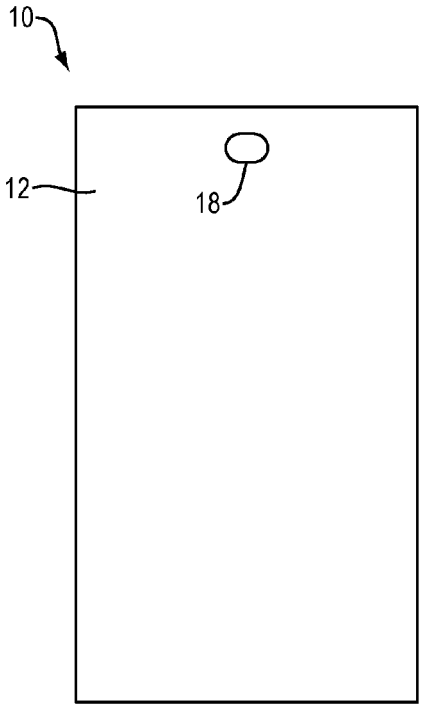
FIG. 2 illustrates the sink cover in a closed position.

Referring now to FIG. 2, the sink cover 10 is shown in its collapsed or folded state. The foldable sections allow for the device to be in a folded state for compact storage or hanging on a wall or side of a counter, for example by way of wall mounting fixture 18.

The sink cover 10 is lightweight, in one embodiment weighing less than two and one half pounds. The material used on some or all of the sink cover is water resistant and easy to clean. The material may also be decorative so that when the sink cover is hung on the wall it looks like a piece of art. The sink cover when unfolded is firm and rigid enough to hold standard beauty appliances and beauty products.

Figure 3:
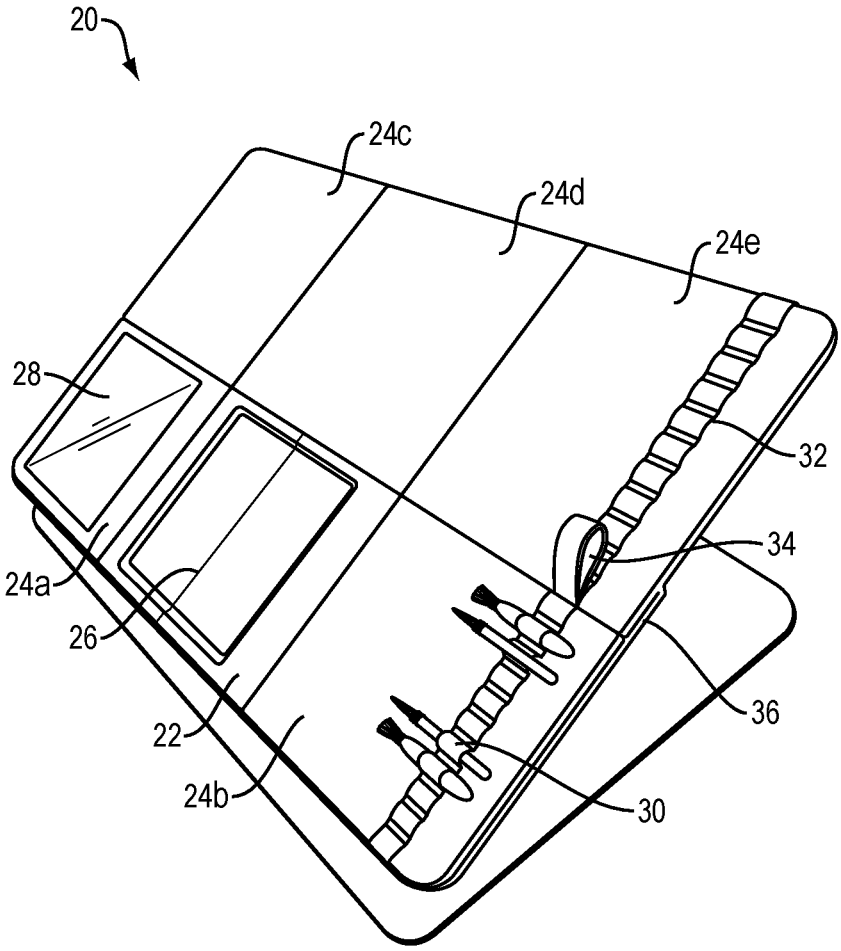
FIG. 3 illustrates a sink cover in accordance with a second embodiment of the invention.

Referring now to FIG. 3, a second embodiment 20 of the sink cover is shown. Sink cover 20 includes a foldable substrate having a base section 22 and at least one foldable section in mechanical communication with said base section or at least one other foldable section, wherein said foldable substrate is capable of being unfolded to cover a sink, and capable of being folded for storage when not being used to cover a sink. The foldable sections shown here include sections 24*a*-24*e*. Also shown are a recessed makeup tray 26 and a mirror 28. Makeup tray 26 is shown disposed in base section 22, but it should be appreciated that the makeup tray is not limited to the base section 26 and could also be disposed in one or more of the foldable sections 24*a*-24*e*. It should be noted that any of the makeup trays, tool trays, pocket mirrors etc. can be disposed in any of the base section and/or foldable sections.

Sink cover 20 also includes a tool loop 30, disposed along a foldable section 24*b*. The tool loop 30 is comprised of an elastic material and features a series of opening between the tool loop 30 and foldable section 24*b* that allow for the insertion of a variety of tools and maintains the tools along the foldable section 24*b*. Also shown is a hang tag 34, in a particular embodiment comprising a loop of material useful for hanging the sink cover 20 when the sink cover 20 is not in use. Foldable section 24*e* includes a closure 32. Closure 32 comprises a piece of material that fits over the foldable sections 24*a*-*e* and base section 26 when the sink cover is in its folded position and maintains the sink cover 20 in the folded position to prevent the sink cover from opening up.

The sink cover 20 additionally includes an overlapping hinge 36 joining foldable section 24*b* with foldable section 24*e*, joining the base section 22 with foldable section 24*d*, and joining foldable section 24*a* with foldable section 24*c*. The overlapping hinge (described in detail below) prevents the sink cover 20 from collapsing when the sink cover 20 is disposed over a sink.

Figure 4:
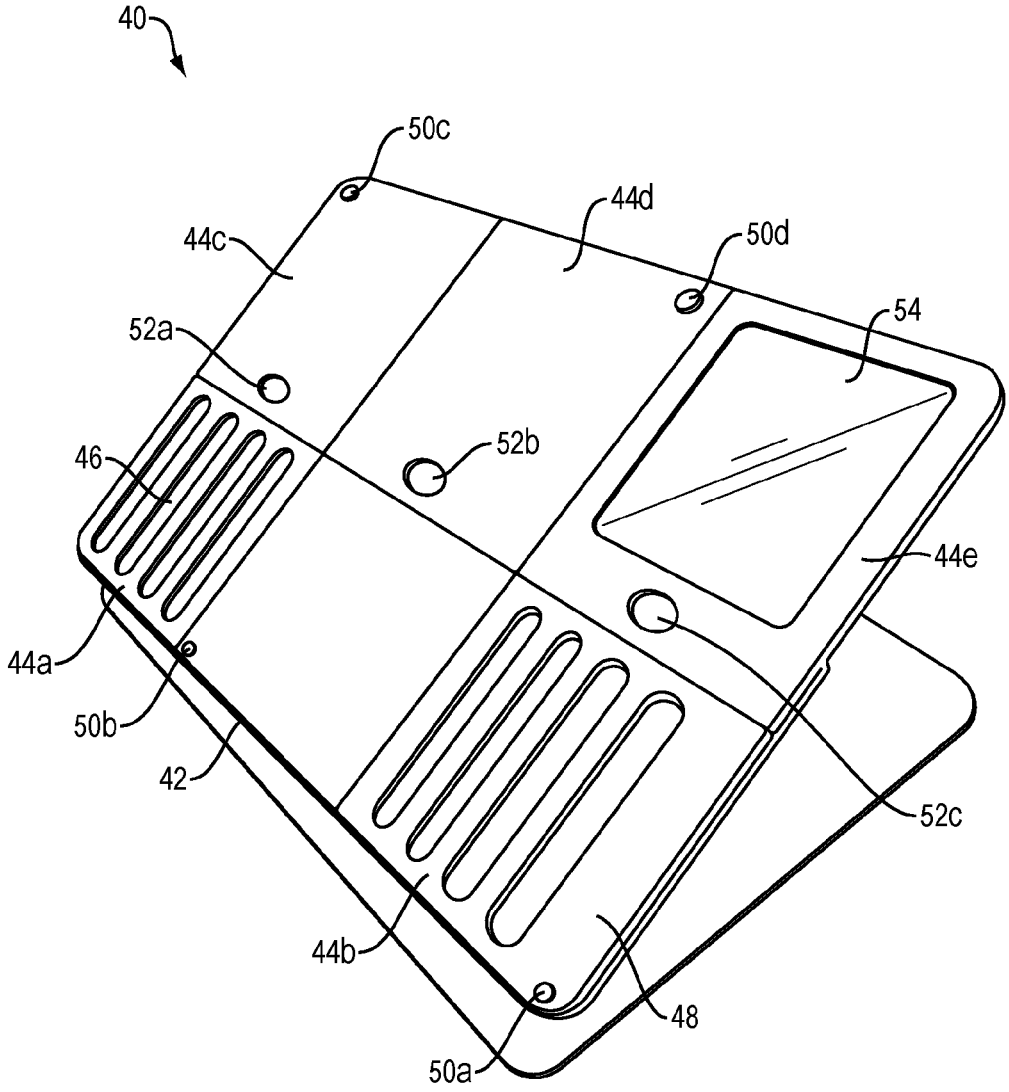
FIG. 4 illustrates a sink cover in accordance with a third embodiment of the invention.

Referring now to FIG. 4, a third embodiment 40 of the sink cover is shown. Sink cover 40, similar to sink cover 20 of FIG. 3, includes a foldable substrate having a base section 42 and at least one foldable section in mechanical communication with said base section or at least one other foldable section, wherein said foldable substrate is capable of being unfolded to cover a sink, and capable of being folded for storage when not being used to cover a sink. The foldable sections shown here include sections 44*a*-44*e*. Sink cover 40 includes a first tool tray 46 disposed in foldable section 44*a* and a second tool tray 48 disposed in foldable section 44*b*. The tool trays 46 and 48 comprise a plurality of elongated oval depressions in their respective foldable section. Each elongated oval depression is sized to support a tool and prevent the tool from moving off from the sink cover 40.

Sink cover 40 further includes a plurality of closures 50*a*-50*d* which in this embodiment are magnetic, although it should be appreciated that other types of closures such as hook-and-loop type closures (e.g., Velcro®) could also be used. Closures 50*a*-50*d* are used to maintain the sink cover 40 in a folded position. Sink cover 40 also includes a plurality of hanging holes 52*a*-52*c*. The hanging holes line up with each other when the sink cover is folded up, and permit the sink cover to be placed on a hook for storage of the sink cover when not in use. In another embodiment, a plurality of holes are provided and a string or rope is run through the holes, providing a loop for hanging the sink cover. Also shown is a mirror 54 disposed in pocket of foldable section 44*e*.

Figure 5:
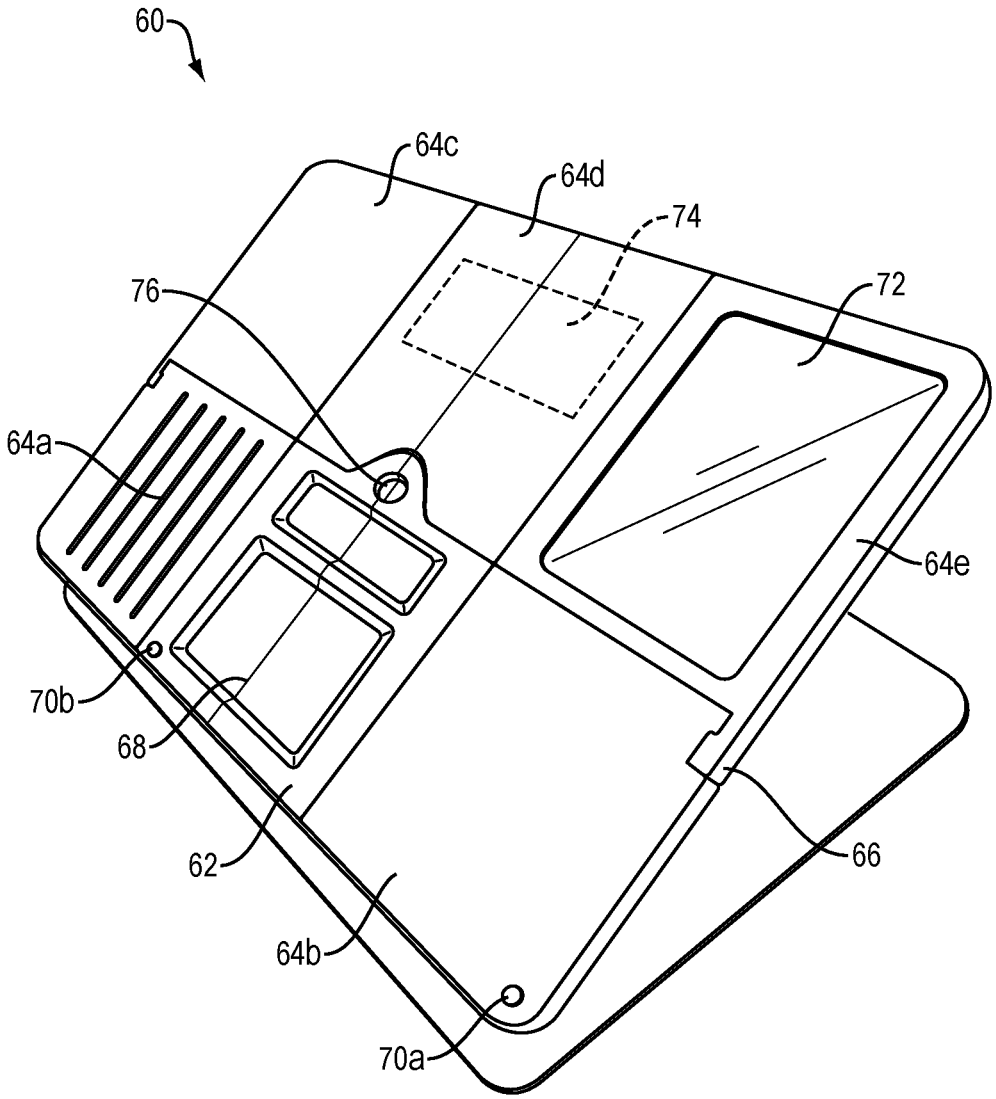
FIG. 5 illustrates a sink cover in accordance with a fourth embodiment of the invention.

Referring now to FIG. 5, a fourth embodiment 60 of the sink cover is shown. Sink cover 60, similar to sink cover 20 of FIG. 3, includes a foldable substrate having a base section 62 and at least one foldable section in mechanical communication with said base section or at least one other foldable section, wherein said foldable substrate is capable of being unfolded to cover a sink, and capable of being folded for storage when not being used to cover a sink. The foldable sections shown here include sections 64*a*-64*e*. Sink cover 60 includes a recessed makeup tray 68 disposed in foldable section 64*a*.

Sink cover 60 further includes a plurality of closures 70*a*-70*b* which in this embodiment are magnetic, although it should be appreciated that other types of closures such as hook-and-loop type closures (e.g., Velcro®) could also be used. Closures 70*a*-70*b* are used to maintain the sink cover 60 in a folded position. Sink cover 60 also includes a hanging hole 76. The hanging hole 76 permit the sink cover, when in the folded up position, to be placed on a hook for storage of the sink cover 60 when not in use. Also shown is a mirror 72 disposed in pocket of foldable section 64*e* and a personalized tag 74 disposed in foldable section 64*d*.

The sink cover 60 additionally includes a molded hinge 66 joining foldable section 64*b* with foldable section 64*e*. A second molded hinge (not shown) joins foldable section 64*a* with foldable section 64*c*. The molded hinge (described in detail below) prevents the sink cover 60 from collapsing when the sink cover 60 is disposed over a sink.

Figure 6:
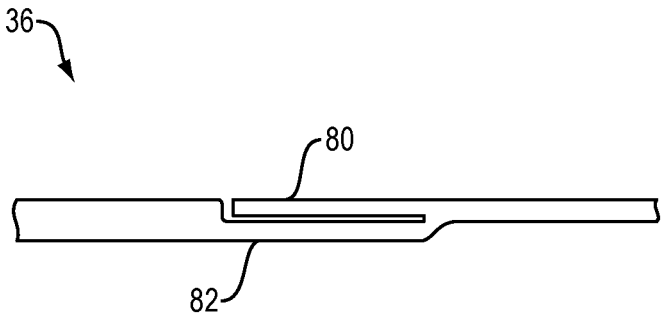
FIG. 6 illustrates an overlapping hinge as shown on the sink cover of FIG. 3 and FIG. 4 in accordance with embodiments of the invention.

FIG. 6 illustrates an overlapping hinge 36 as shown on the sink cover of FIG. 3 and FIG. 4. The overlapping hinge 36 features a first overlapping part 80 in mechanical communication with a second overlapping part 82. When the hinge 36 is opened as shown, an object placed on the sink cover does not cause the sink cover to fold. When the hinge is placed in the closed position, the sink cover can be folded and stored.

Figure 7:
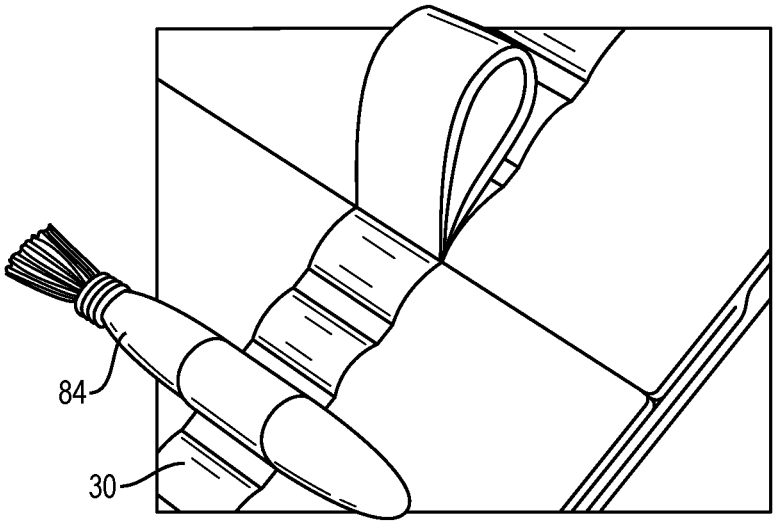
FIG. 7 illustrates a tool loop in accordance with embodiments of the invention.

FIG. 7 illustrates a tool loop 30. Tool loop 30 includes several openings. A tool, in this example a makeup brush 84, can be inserted within the opening defined by the tool loop 30 and a foldable section or base section and secures the tool therein.

Figure 8:
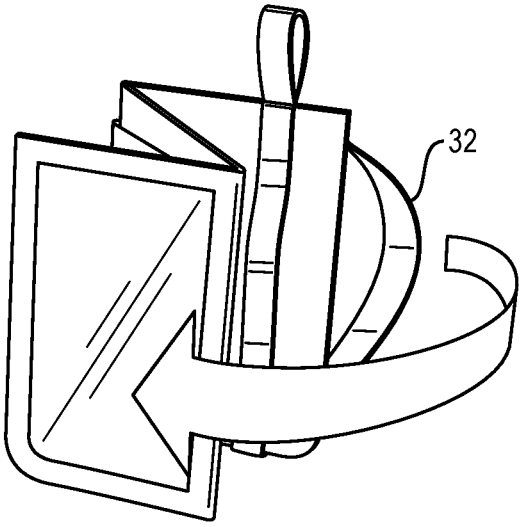
FIG. 8 illustrates a closure in accordance with embodiments of the invention.

FIG. 8 illustrates a closure 32. The closure is typically comprised of an elastic-type material. When the sink cover is in a folded position, the closure 32 can be used to secure the base and foldable sections together to keep the sink cover form opening.

Figure 9:
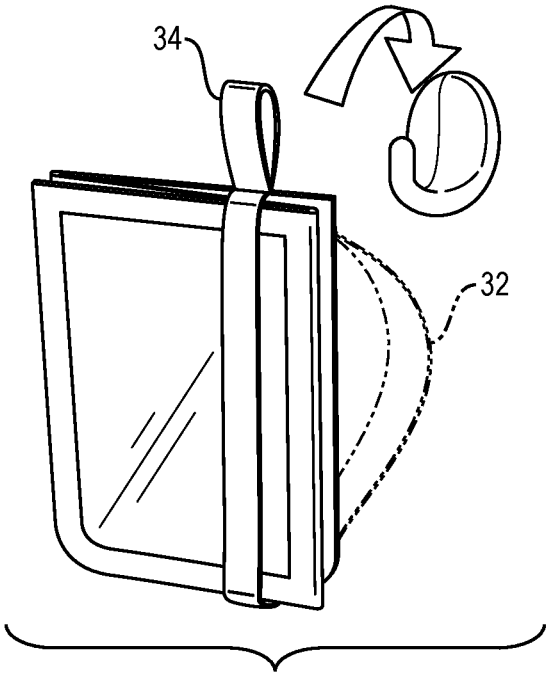
FIG. 9 illustrates a hang tag in accordance with embodiments of the invention.

FIG. 9 illustrates a hang tag 34. The hang tag 34 is used when the sink cover is in the folded position to hang the sink cover on a wall for temporary storage when the sink cover is not in use.

Figure 10:
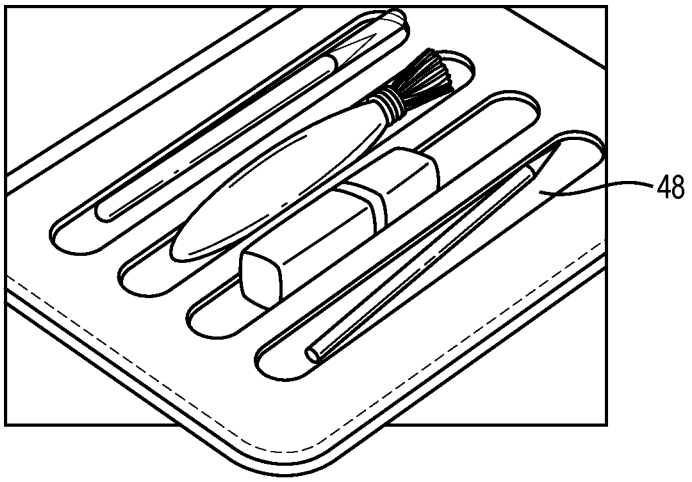
FIG. 10 illustrates a tool tray in accordance with embodiments of the invention.

FIG. 10 illustrates a tool tray 48. The tool tray 48 comprises a plurality of elongated parallel oval depressions in a foldable section or base section. Each elongates oval depression is sized to support a tool and prevent the tool from moving off from the sink cover. As illustrated in FIG. 10, different makeup article such as a pencil, brush, lipstick or eye-liner can be placed in respective depressions to prevent the items from moving around on the sink cover.

Figure 11:
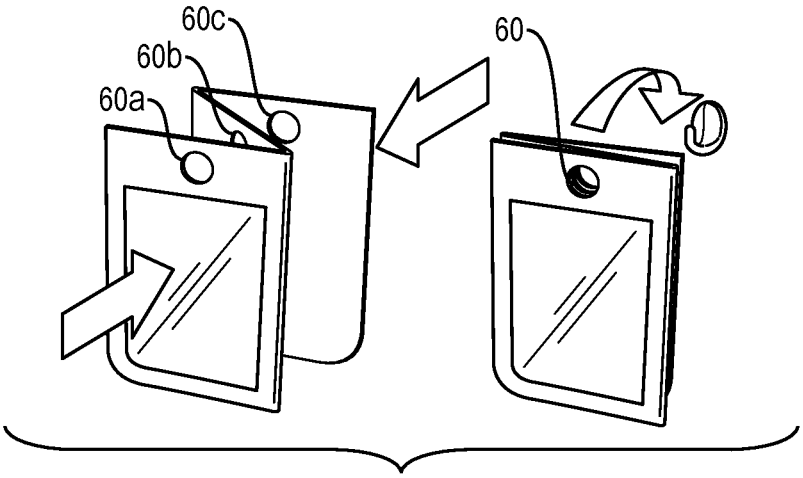
FIG. 11 illustrates an opening for hanging the sink cover in accordance with embodiments of the invention.

FIG. 11 illustrates an opening 60 for hanging the sink cover in accordance with a embodiments of the invention. The opening 60 comprises three overlapping holes 60*a*-60*c* in base sections and/or foldable sections and is used when the sink cover is in the folded position to hang the sink cover on a wall for temporary storage when the sink cover is not in use.

Figure 12:
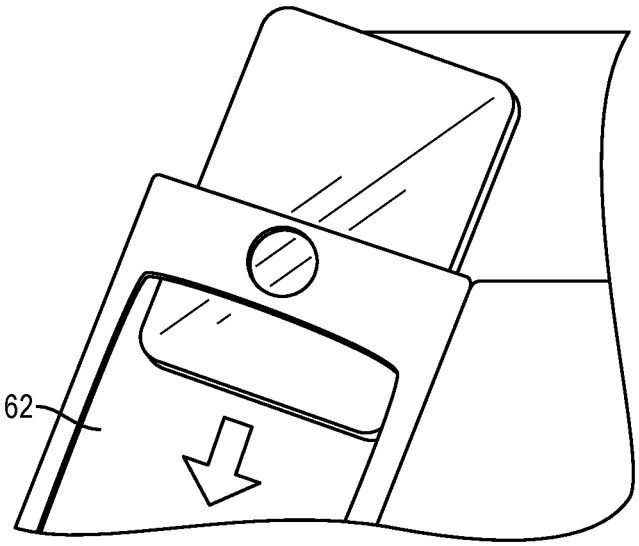
FIG. 12 illustrates a pocket in accordance with embodiments of the invention.

FIG. 12 illustrates a pocket 62. The pocket 62 is used to hold a mirror or other item and provides an ability to insert and remove objects easily.

Figure 13:
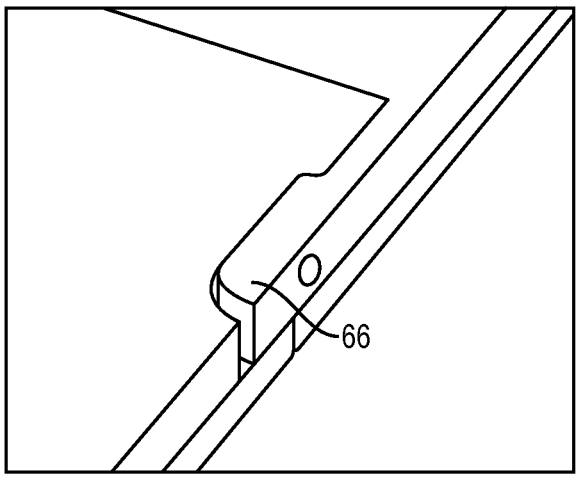
FIG. 13 illustrates a molded hinge as shown on the sink cover of FIG. 5 in accordance with embodiments of the invention.

FIG. 13 illustrates a molded hinge 66 as shown on the sink cover of FIG. 5. The molded hinge 66 movable secures a first foldable section to a second foldable section and allows the first foldable section to be rotated from a parallel adjacent position with the second foldable section to an overlapping position with the second foldable section.

Figure 14:
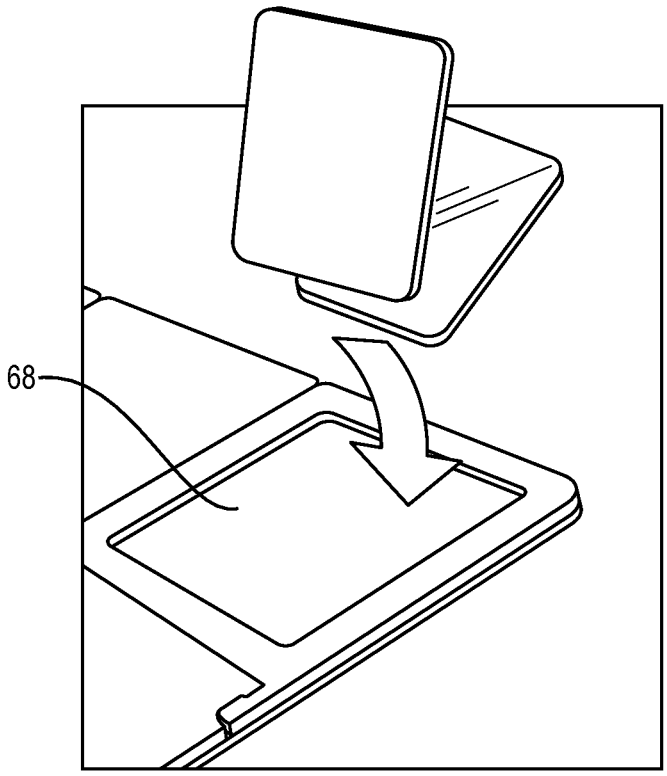
FIG. 14 illustrates an insert in accordance with embodiments of the invention.

FIG. 14 illustrates an insert 68. Insert 68 can be used to identify the manufacturer of the sink cover or to add a degree of personalization such as the owner's initials to the sink cover.

Figure 15:
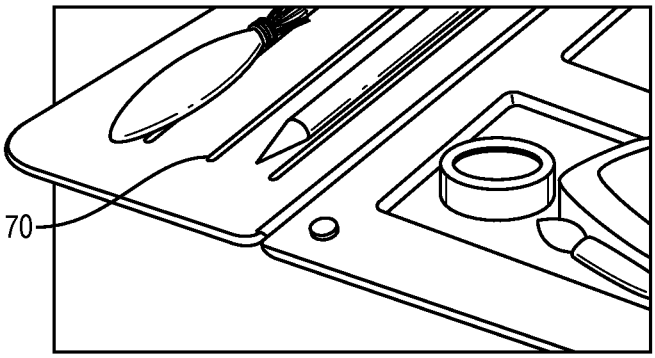
FIG. 15 illustrates raised ribs in accordance with embodiments of the invention.

FIG. 15 illustrates raised ribs 70 for a tool tray. The tool tray 70 comprises a plurality of parallel raised ribs in a foldable section or base section. Each space between raised ribs is sized to support a tool and prevent the tool from moving off from the sink cover. A different makeup article such as a pencil, brush, lipstick or eye-liner can be placed in respective areas between the raised ribs to prevent the items from moving around on the sink cover.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

Having described preferred embodiments of the invention it will now become apparent to those of ordinary skill in the art that other embodiments incorporating these concepts may be used. Accordingly, it is submitted that that the invention should not be limited to the described embodiments but rather should be limited only by the spirit and scope of the appended claims.

What is claimed is:

1. A sink cover comprising:

a foldable substrate having a base section and at least one foldable section, wherein each foldable section is either in mechanical communication with said base section or a different foldable section, wherein said foldable substrate is capable of being unfolded to cover a sink, and capable of being folded for storage when not being used to cover the sink; and an overlapping hinge joining said base section with a first foldable section of the at least one foldable section, said overlapping hinge preventing said sink cover from collapsing when said sink cover is disposed over the sink, wherein said overlapping hinge comprises a first overlapping part extending from said first foldable section, said first overlapping part in mechanical communication with a second overlapping part, said second overlapping part extending from said base section and having a thickness less than a thickness of said base section, wherein when said overlapping hinge is in an open position said first overlapping part overlaps said second overlapping part such that a top surface of said base section is level with a top surface of said first foldable section and wherein an object placed on said sink cover does not cause said sink cover to fold.

2. The sink cover of claim 1 further comprising a tool tray disposed in one of said base section or a foldable section of said at least one foldable section.

3. The sink cover of claim 1 further comprising at least one anti-roll rib disposed in one of said base section or a foldable section of said at least one foldable section.

4. The sink cover of claim 1 further comprising an insert disposed in one of said base section or a foldable section of said at least one foldable section.

5. The sink cover of claim 1 further comprising a recessed tray disposed in one of said base section or a foldable section of said at least one foldable section.

6. The sink cover of claim 1 further comprising a tool loop disposed in one of said base section or a foldable section of said at least one foldable section.

7. The sink cover of claim 1 further comprising a hang tag disposed in one of said base section or a foldable section of said at least one foldable section.

8. The sink cover of claim 1 further comprising a hang hole disposed in one of said base section or a foldable section of said at least one foldable section.

9. The sink cover of claim 1 further comprising a pocket disposed in one of said base section or a foldable section of said at least one foldable section.

10. The sink cover of claim 1 further comprising a closure disposed in one of said base section or a foldable section of said at least one foldable section.

11. The sink cover of claim 10 wherein said closure comprises a magnet disposed on one of said base section and said foldable section of said at least one foldable section and a corresponding magnet or magnetic material disposed on the other of said base section and said foldable section of said at least one foldable section.

12. The sink cover of claim 10 wherein said closure comprises a hook and loop closure comprising a hook portion disposed on one of said base section and said foldable section of said at least one foldable section and a corresponding loop portion disposed on the other of said base section and said foldable section of said at least one foldable section.

* * * * *